US011753787B1

(12) United States Patent
Odenbach

(10) Patent No.: US 11,753,787 B1
(45) Date of Patent: Sep. 12, 2023

(54) WAVE SUPPRESSION DEVICE

(71) Applicant: Peter Odenbach, Melbourne, FL (US)

(72) Inventor: Peter Odenbach, Melbourne, FL (US)

(73) Assignee: Peter Odenbach, Melbourne, FL (US)

( * ) Notice: Subject to any disclaimer, the term of this patent is extended or adjusted under 35 U.S.C. 154(b) by 0 days.

(21) Appl. No.: 17/822,225

(22) Filed: Aug. 25, 2022

(51) Int. Cl.
*E02B 3/06* (2006.01)

(52) U.S. Cl.
CPC ..... *E02B 3/062* (2013.01)

(58) Field of Classification Search
CPC ..... E02B 3/062; E02B 3/06; E02B 9/08
USPC ..... 405/21, 26
See application file for complete search history.

(56) References Cited

U.S. PATENT DOCUMENTS 9,863,395 B2 * 1/2018 Rohrer ..... F03B 13/182

FOREIGN PATENT DOCUMENTS

DE 2405197 * 8/1974

* cited by examiner

*Primary Examiner* — Sean D Andrish
(74) *Attorney, Agent, or Firm* — Widerman Malek, PL; Daniel C. Pierron

(57) ABSTRACT

A wave suppressor device including a float member that includes end members, having a first aperture, wall members extending between the end members and defining a subsurface member receiving space, and a subsurface member axle configured to be positioned at least partially within and extend between the first aperture of each of the end members. The wave suppressor device further includes a subsurface member positioned partially within the subsurface member receiving space and extend outward, the subsurface member including an attachment section configured to rotatably attach to the subsurface member axle and a damping member.

19 Claims, 3 Drawing Sheets

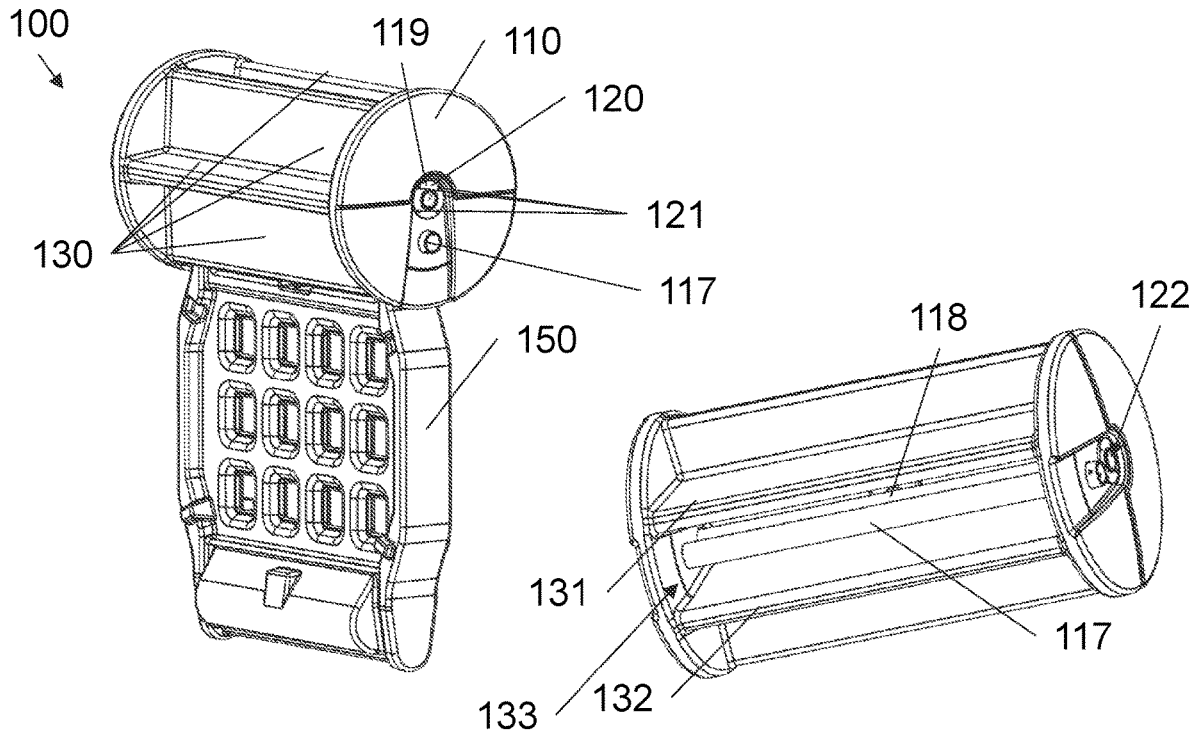
FIG. 1
FIG. 2
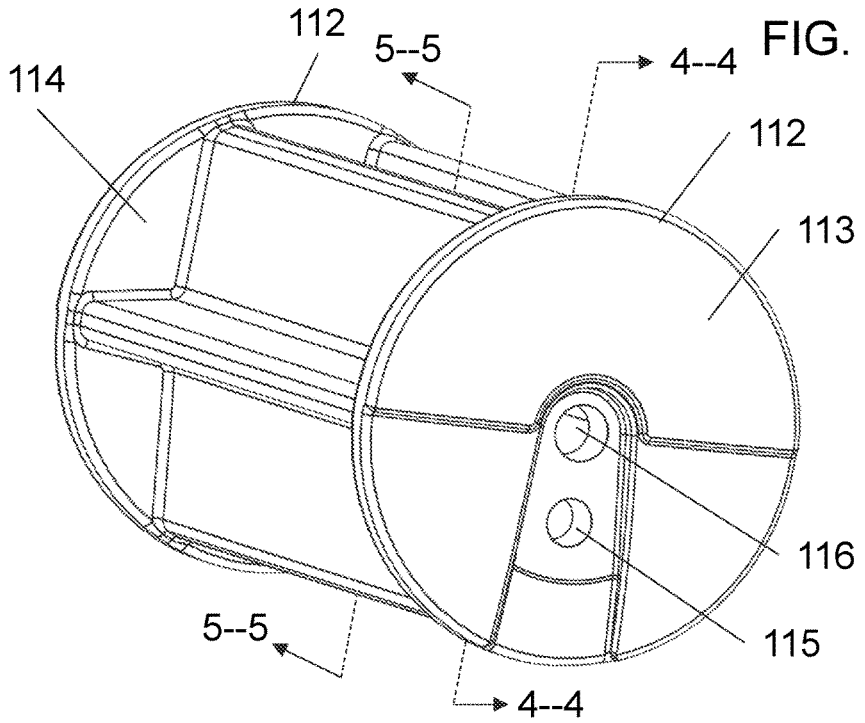
FIG. 3

WAVE SUPPRESSION DEVICE

FIELD OF THE INVENTION

The present invention relates to systems for suppressing surface and near-surface waves in bodies of fluid, particularly bodies of water.

BACKGROUND OF THE INVENTION

The use of wave suppression devices is generally well known. For example, U.S. Pat. No. 5,558,459 utilizes a plurality of radially-oriented fins bounded by end caps to disperse surface wave energy. However, this solution has two drawbacks. First, this design requires anchoring of the device to the floor of the body of water within which it is deployed, requiring specialized tools to do so as well as disturbing and potentially damaging the floor, causing harm to the flora and fauna there. Such anchoring is necessary to prevent the device from spinning on its axis, thereby transmitting the wave energy through the device. Second, this device does not impact wave energy much below the surface of the water, allowing significant wave propagation beyond the device from the undissipated energy below the water surface. Accordingly, there is a need in the art for a wave suppressing device that can prevent rolling without requiring anchoring and/or having improved wave energy dissipation capability below the surface of the water.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a wave suppressor device. The wave suppressor device includes a float member that may include a pair of opposing end members, each end member may include a first aperture, a plurality of wall members extending between the end members, a first wall member and a second wall member of the plurality of wall members defining a subsurface member receiving space, and a subsurface member axle configured to be positioned at least partially within and extend between the first aperture of each of the end members. The wave suppressor device also includes a subsurface member configured to be positioned partially within the subsurface member receiving space and extend outward from an axis of the float member. The subsurface member may include an attachment section configured rotatably attach to the subsurface member axle and a damping member configured to rotate about a rotational axis defined by the subsurface member axle.

Embodiments of the wave suppressor device above may include one or more of the following features. The wave suppressor device where the damping member may include a central wall defining a plurality of apertures configured to permit fluid to flow therethrough. The damping member further may include opposing sidewalls, and the central wall is positioned between the opposing sidewalls. In some embodiments, the opposing sidewalls each may include an upper angled section and a lower angled section, a depression formed in the upper angled section, and an outcropping extending from the lower angled section, the outcropping being configured to be positioned at least partially within a depression of another opposing sidewall.

In some embodiments, the damping member further may include a ballast member positioned at a lower end of the central wall, the ballast member having a greater density than the central wall. The ballast member may include: a ballast housing defining an interior volume, and a ballast material positioned within the interior volume of the ballast housing. The ballast housing may include a releasable door that may be positioned in a closed configuration to secure the ballast material in the interior volume and positioned in an open configuration to enable access to the ballast material.

In some embodiments, the central wall may include an internal cavity. In some embodiments, the attachment section of the subsurface member may include a pair of opposing arms, each arm may include an axle aperture to permit the subsurface member axle to pass therethrough. At least a portion of the damping member may be integrally formed with the attachment section.

In some embodiments, the end members and the plurality of wall members are integrally formed as a single structure. In some embodiments, the opposing end members each may include a second aperture, at least a subset of the wall members of the plurality of wall members cooperate to define a central axle space, and the float member may include a central axle that may include a body member configured to pass through the second apertures of the end members and end attachments attached to opposing ends of the body member and may include a flange configured to engage with an outer surface of the end members, the end attachments being configured to prevent movement of the body member along a longitudinal axis of the body member relative to the end members. The central axle space may be contiguous with the subsurface member receiving space.

In some embodiments, the device may include a first pair of wall members of the plurality of wall members that cooperate to define a first latitudinal axis thereof that is offset from a longitudinal axis of the float member at a first position, a second pair of wall members of the plurality of wall members cooperate to define a second latitudinal axis thereof that is offset from the longitudinal axis of the float member at a second position and is parallel to the first latitudinal axis, and the first and second pairs of wall members cooperate to define the subsurface member receiving space. The plurality of wall members may include an intermediate wall member formed between the first and second pairs of wall members, the intermediate wall member may include a drain formed therein, the drain being configured to permit the flow of fluid that collects in a space between upper portions of the first and second pairs of wall members therethrough and to the subsurface member receiving space.

BRIEF DESCRIPTION OF THE DRAWINGS

Some embodiments of the present invention are illustrated as an example and are not limited by the figures of the accompanying drawings, in which like references may indicate similar elements.

FIG. 1 is front perspective view of a wave suppression device according to an embodiment of the present invention.

FIG. 2 is a lower perspective view of the wave suppression device of FIG. 1 with a subsurface member removed.

FIG. 3 is a perspective view of the wave suppression device of FIG. 1 with the subsurface member and two axles removed.

DETAILED DESCRIPTION OF THE INVENTION

Figure 4:
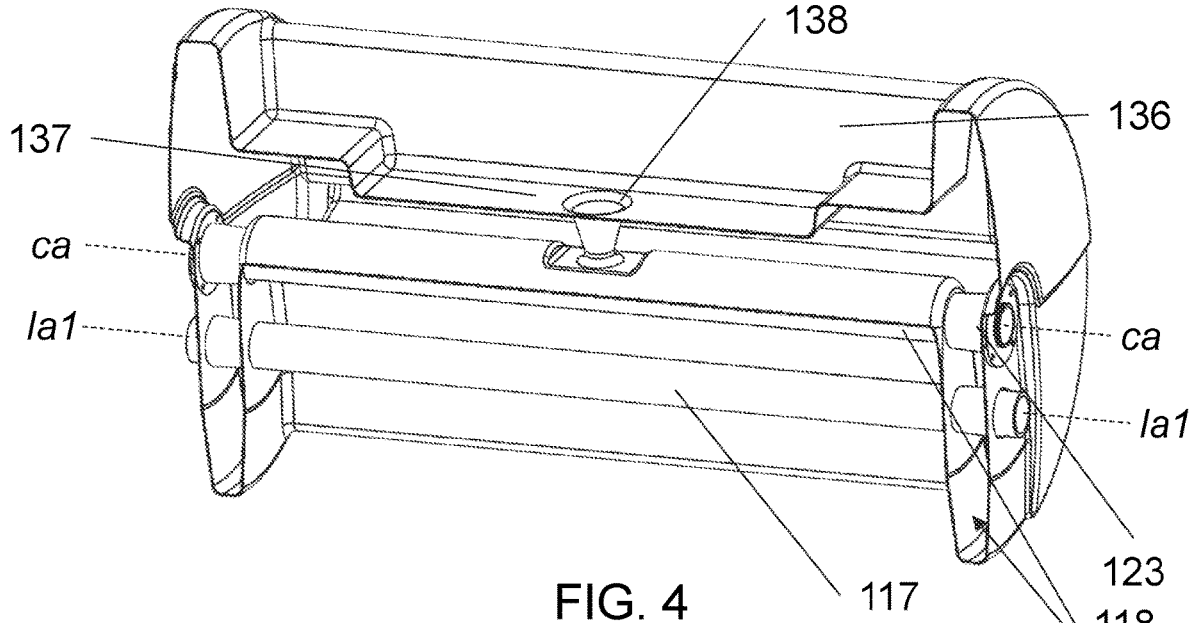
FIG. 4 is a front perspective sectional view of a float member of the wave suppression device of FIG. 1.
Figure 5:
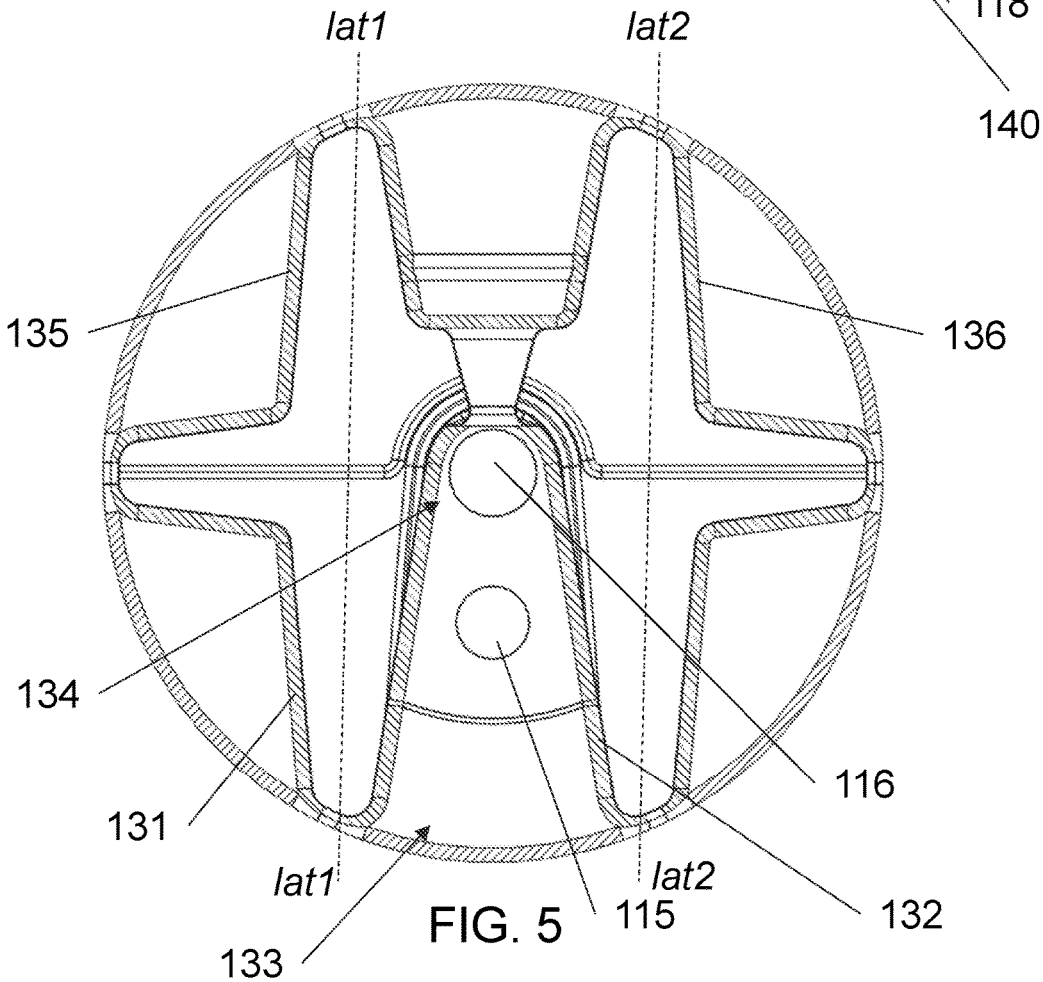
FIG. 5 is a side sectional view of the float member of the wave suppression device of FIG. 1 with two axles removed.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a wave suppression device. Referring now specifically to FIGS. 1-7, a wave suppression device 100 according to an embodiment of the invention is presented. The wave suppression device 100 may comprise a float member 110 and a subsurface member 150. The float member 110 may be generally configured to provide buoyancy and dissipate surface wave energy. The subsurface member 150 may be generally configured to resist rotation of the float member 110, increase the mass of the wave suppression device 100, and dissipate subsurface wave energy. The subsurface member 150 may be rotatably attached to the float member 110 such that it may swing independently of the float member 110 within a constrained rotational range.

The float member may comprise a pair of opposing end members 112 and a plurality of wall members 130. The end members 112 may have an inner surface 114 and an outer surface 113. The end members 112 may have any general geometric shape; in the present application, the end members 112 are generally circular. The plurality of wall members 130 may extend between and connect the inner surfaces 114 of the end members 112. In some embodiments, the end members 112 and the plurality of wall members 130 may be integrally formed as a single structure. For example, they may be formed by injection molding. In other embodiments, the end members 112 may be joined to the plurality of wall members 130. Such joining may be accomplished by any method as is known in the art, included but not limited to, welding, adhesives, glues, fasteners, and the like. In the present embodiment, the plurality of wall members 130 comprises six wall members. Any number of wall members is contemplated and included within the scope of the invention.

The end members 112 may comprise apertures. In some embodiments, the end members may comprise a first aperture 115. The first aperture 115 may extend through the end member 112 and create openings in each of the inner surface 114 and the outer surface 113. The first aperture 115 may be configured to facilitate the attachment of the subsurface member 150 to the float member 110. The first apertures 115 of the end members 112 may be positioned so as to be aligned such that a structure may pass through and extend between the first apertures 115. In such embodiments, the first apertures 115 may define a longitudinal axis la1. In such embodiments, the first apertures 115 may be offset from, and in some embodiments parallel to, a longitudinal central axis ca of the float member 100. The end members 112 may further comprise second apertures 116. The second apertures 116 may be positioned so as to form a longitudinal axis therebetween that is collinear with the longitudinal central axis ca.

The float member 110 may further comprise a first axle 117. The first axle 117 may be configured to be positioned within the first apertures 115 and extend between the end members 112. The first axle 117 may further be configured to facilitate the rotatable attachment of the subsurface member 150 thereto, as discussed in greater detail below. In some embodiments, a portion of the first axle 117 may extend outward beyond the outer surfaces 113 of the end members 112. The first axle 117 may be held in position within the first apertures by any means or method as is known in the art, including, but not limited to, fasteners, such as nut-and-screws and cotter pins, interference fit, threads, adhesives, magnetic attachment, and the like. The first axle 117 may be referred to as a subsurface member axle.

The float member 110 may further comprise a second axle 118. The second axle 118 may be configured to be positioned within the second apertures 116 and extend between the end members 112. In some embodiments, the second axle 118 may be tubular and have a hollow interior, defining a channel through the second axle 118. The second axle 118 may comprise end attachments 119. The end attachments 119 may be configured to attach to the ends of the second axle 118. Such attachment may be accomplished by any means or method as is known in the art, including, but not limited to, threaded engagement, interference fit, fasteners, magnetic attachment, and the like. The end attachments 119 may include a flange 120. The flange 120 may be configured to interface with the outer surface 113, thereby limiting the movement of the second axle 118 along axis ca. In some embodiments, the flange 120 may comprise a plurality of holes 121. In some embodiments, the plurality of holes 121 may facilitate the attachment of an end attachment comprised by a float member positioned adjacent to the float member 110 to limit the relative movement therebetween. The end attachment 119 may define a central conduit 122 that may be in fluidic communication with the channel of the second axle 118, thereby enabling the flow of fluid through the second axle 118 and out the end attachment 119. The end attachments 119 may further comprise a neck section 123 configured to extend between the end member 112 to which it is attached and a wall member of the plurality of wall members 130, forming a watertight seal therewith to prevent the flow of fluid into an internal cavity 140 formed by of the plurality of wall members 130.

The plurality of wall members 130 may be configured to form interstitial spaces between adjacent wall members into which fluid may flow. In particular, a subset of the plurality of wall members 130, namely, a first wall member 131 and a second wall member 132, may define a space there between within which the subsurface member 150 may be positioned to attach to the float member 110, defining a subsurface member receiving space 133. Accordingly, the first axle 117 may be positioned through the subsurface member receiving space 133. In some embodiments, the same first and second wall members 131, 132 may also define a space through which the second axle 118 extends, defining a central axle space 134. In some embodiments, the central axle space 134 and the subsurface member receiving space 133 may be contiguous with one another, such that there are no barriers or obstructions there between.

In some embodiments, the first wall member 131 and a third wall member 135, defining a first pair of wall members, may cooperate to define a first latitudinal axis lat1. The first latitudinal axis lat1 may be offset from the longitudinal axis of the float member, i.e. central axis ca, at a first distance from central axis ca and in a first location. The first latitudinal axis lat1 may be skew from central axis ca. The second wall member 132 and a fourth wall member 136, defining a second pair of wall members, may cooperate to define a second latitudinal axis lat2. The second latitudinal axis lat2 may be offset from the central axis at a second distance from central axis ca and in a second location. The second distance may be equal to the first distance, such that lat2 is effectively mirrors lat1 with respect to a plane defined by ca. The second latitudinal axis la2 may also be skew to central axis ca and may be parallel to lat1.

The plurality of wall members 130 may further comprise an intermediate wall member 137 positioned between the third and fourth wall members 135, 136. The intermediate wall member 137 may have a drain 138 formed there within. The drain 138 may enable fluidic communication between the space between the third and fourth wall members 135, 136 and at least one of the central axle space 134 and the subsurface member receiving space 133, or both. This may prevent the collection of water in the space between the third and fourth wall members 135, 136 by allowing water to flow through the drain 138, through the central axle space 134 and/or the subsurface member receiving space 133, and into the body of water within which the wave suppression device 100 is positioned.

Figure 6:
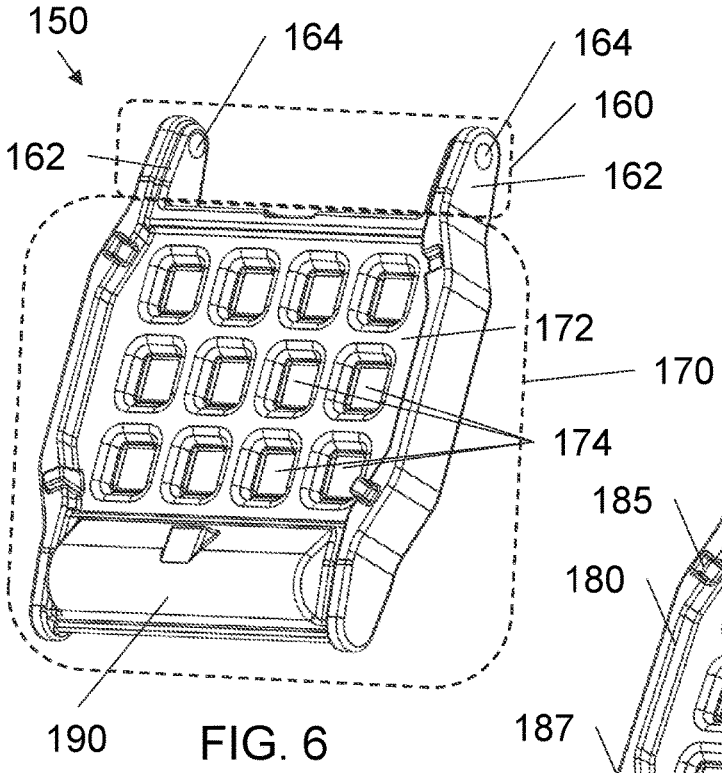
FIG. 6 is a perspective view of the subsurface member of the wave suppression device of FIG. 1.
Figure 7:
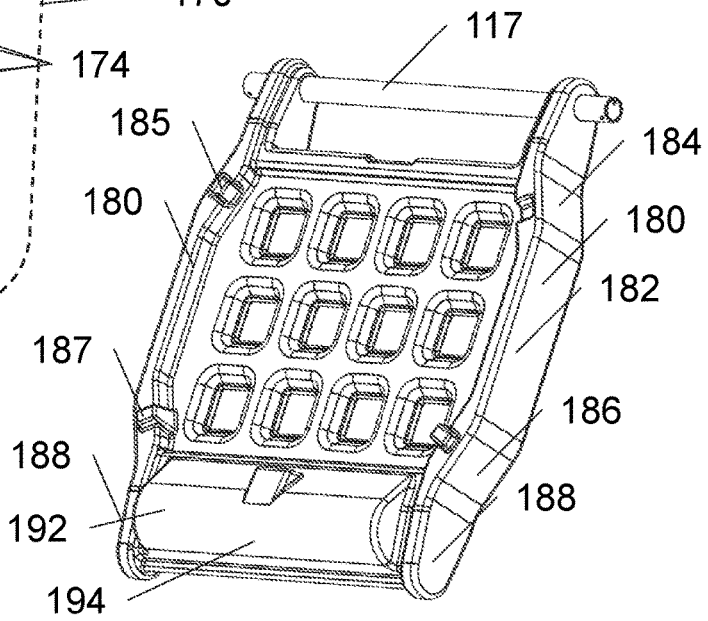
FIG. 7 is a perspective view of the subsurface member of the wave suppression device of FIG. 1 with an axle shown.

Referring now specifically to FIGS. 6 and 7, further aspects of the subsurface member 150 will be discussed in detail. The subsurface member 150 may comprise an attachment section 160 and a damping member 170. The attachment section 160 may be configured to rotatably attach to the float member 110 such that the subsurface member may rotate independently of the float member 110 at least within an angular range. Such angular range may be defined by the dimensions of the attachment section 160 and the subsurface member receiving space 133. The attachment section may comprise a pair of opposing arms 162. The opposing arms 162 may extend away from the damping member 170. Each arm 162 may comprise an axle bore 164 configured to have a central axis that is collinear with the central axis of the axle bore of the other arm 162. This may enable the first axle 117 to pass through the axle bores 164, thereby rotatably attaching the subsurface member 150 to the float member 110.

The damping member 170 may comprise a central wall 172. The central wall 172 may define a plurality of apertures 174. The plurality of apertures 174 of the central wall 172 may be configured to permit fluid to flow therethrough. Such flow of fluid may prevent the over-rotation of the subsurface member 150 relative to the float member 110, thereby keeping the wave suppression device 100 in an orientation where the subsurface member 150 is generally below the float member 110, as shown in FIG. 1. The central wall 172 may comprise any number of apertures. The central wall 172 may be hollow, having an internal cavity.

The damping member 170 may further comprise opposing sidewalls 180. The opposing sidewalls 180 may be positioned on opposite sides of the central wall 172, thereby bounding the central wall 172 there between. In some embodiments, the opposing sidewalls 180 and the central wall 172 may be integrally formed as a single structure. The opposing sidewalls 180 may each comprise a central section 182, and angled upper section 184, and an angled lower section 186. The angled upper section 184 may comprise a depression 185 formed there within, and the angled lower section 186 may comprise an outcropping 187 formed thereon and extending outward therefrom. The outcropping 187 may be configured to be positioned within the depression 185 of an adjacent, stacked subsurface member 150 when detached from the float member 110 in pre-deployment storage, so as to inhibit the relative movement of stacked subsurface members 150 when stacked. In some embodiments, the opposing arms 162 of the attachment section 160 may extend from the upper angled section 184 of the opposing sidewalls 180. In some embodiments, the opposing arms 162 may be integrally formed with the opposing sidewalls 180.

The damping member 170 may further comprise a ballast member 190. The ballast member 190 may be located at a lower end of the central wall 172, on an opposite side of the central wall 172 from the attachment section 160. In some embodiments, the opposing sidewalls 180 may comprise ballast attachment arms 188 extending from the lower angled section 186 to which the ballast member 190 may be one of attached to and integrally formed with. The ballast member 190 may comprise a ballast housing 192 defining an interior volume and a ballast material (not shown) positioned within the interior volume of the ballast housing 192. The ballast material may be a substance having a density greater than the material forming the subsurface member 150 or parts thereof, such that the relative greater density of the ballast material may cause the subsurface member 150 to be biased towards the orientation depicted in FIG. 1 with the subsurface member 150 beneath the float member 110 and the ballast member 190 being at a lower end of the wave suppression device 100. The ballast housing 192 may further comprise a releasable door 194 that may be positioned in a closed configuration (as shown in the figures) to secure the ballast material in the interior volume and positioned in an open configuration to enable access to the ballast material.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made, and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced items.

Thus, the scope of the invention should be determined by the appended claims and their legal equivalents, and not by the examples given.

What is claimed is:

1. A wave suppressor device comprising:

a float member comprising:

a pair of opposing end members, each end member comprising a first aperture and a second aperture;

a plurality of wall members extending between the end members, a first wall member and a second wall member of the plurality of wall members defining a subsurface member receiving space, at least a subset of the plurality of wall members cooperating to define a central axle space;

a subsurface member axle configured to be positioned at least partially within and extend between the first aperture of each of the end members; and a central axle comprising:

a body member configured to pass through the second apertures of the end members; and end attachments attached to opposing ends of the body member and comprising a flange configured to engage with an outer surface of the end members, the end attachments being configured to prevent movement of the body member along a longitudinal axis of the body member relative to the end members; and a subsurface member configured to be positioned partially within the subsurface member receiving space and extend outward from the subsurface member axle of the float member, the subsurface member comprising:

an attachment section configured to rotatably attach to the subsurface member axle; and a damping member.

2. The wave suppressor device of claim 1 wherein the damping member comprises a central wall defining a plurality of apertures configured to permit fluid to flow therethrough.

3. The wave suppressor device of claim 2 wherein:

the damping member further comprises opposing sidewalls; and the central wall is positioned between the opposing sidewalls.

4. The wave suppressor device of claim 3 further comprising:

the opposing sidewalls each comprise an upper angled section and a lower angled section;

a depression formed in the upper angled section; and an outcropping extending from the lower angled section, the outcropping being configured to be positioned at least partially within a depression of another opposing sidewall.

5. The wave suppressor device of claim 2 wherein the damping member further comprises a ballast member positioned at a lower end of the central wall, the ballast member having a greater density than a density of the central wall.

6. The wave suppressor device of claim 5 wherein the ballast member comprises:

a ballast housing defining an interior volume; and a ballast material positioned within the interior volume of the ballast housing.

7. The wave suppressor device of claim 6 wherein the ballast housing comprises a releasable door that may be positioned in a closed configuration to secure the ballast material in the interior volume and positioned in an open configuration to enable access to the ballast material.

8. The wave suppressor device of claim 2 wherein the central wall comprises an internal cavity.

9. The wave suppressor device of claim 1 wherein the attachment section of the subsurface member comprises a pair of opposing arms, each arm comprising an axle aperture to permit the subsurface member axle to pass therethrough.

10. The wave suppressor device of claim 1 wherein at least a portion of the damping member is integrally formed with the attachment section.

11. The wave suppressor device of claim 1 wherein the end members and the plurality of wall members are integrally formed as a single structure.

12. The wave suppressor device of claim 1 wherein the central axle space is contiguous with the subsurface member receiving space.

13. The wave suppressor device of claim 1 wherein:

a first pair of wall members of the plurality of wall members cooperate to define a first latitudinal axis thereof that is offset from a longitudinal axis of the float member at a first position;

a second pair of wall members of the plurality of wall members cooperate to define a second latitudinal axis thereof that is offset from the longitudinal axis of the float member at a second position and is parallel to the first latitudinal axis; and the first and second pairs of wall members cooperate to define the subsurface member receiving space.

14. The wave suppressor device of claim 13 wherein the plurality of wall members comprises an intermediate wall member formed between the first and second pairs of wall members, the intermediate wall member comprising a drain formed therein, the drain being configured to permit a flow of fluid that collects in a space between upper portions of the first and second pairs of wall members therethrough and to the subsurface member receiving space.

15. A wave suppressor device comprising:

a float member comprising:

a pair of opposing end members, each end member comprising a first aperture;

a plurality of wall members extending between the end members, a first wall member and a second wall member of the plurality of wall members defining a subsurface member receiving space;

a subsurface member axle configured to be positioned at least partially within and extend between the first aperture of each of the end members;

a subsurface member configured to be positioned partially within the subsurface member receiving space and extend outward from subsurface member axle, the subsurface member comprising:

an attachment section configured rotatably attach to the subsurface member axle; and a damping member comprising:

opposing sidewalls;

a central wall positioned between the opposing sidewalls and comprising a plurality of apertures configured to permit fluid to flow therethrough; and a ballast member positioned at a lower end of the central wall, the ballast member having a greater density than a density of the central wall.

16. The wave suppressor device of claim 15 wherein the ballast member comprises:

a ballast housing defining an interior volume; and a ballast material positioned within the interior volume of the ballast housing.

17. The wave suppressor device of claim 15 wherein:

the opposing end members each comprise a second aperture;

at least a subset of the wall members of the plurality of wall members cooperate to define a central axle space; and the float member comprises a central axle comprising:

a body member configured to pass through the second apertures of the end members; and end attachments attached to opposing ends of the body member and comprising a flange configured to engage with an outer surface of the end members, the end attachments being configured to prevent movement of the body member along a longitudinal axis of the body member relative to the end members.

18. The wave suppressor device of claim 15 wherein:

a first pair of wall members of the plurality of wall members cooperate to define a first latitudinal axis thereof that is offset from a longitudinal axis of the float member at a first position;

a second pair of wall members of the plurality of wall members cooperate to define a second latitudinal axis thereof that is offset from the longitudinal axis of the float member at a second position and is parallel to the first latitudinal axis; and the first and second pairs of wall members cooperate to define the subsurface member receiving space.

19. A wave suppressor device comprising:

a float member comprising:

a pair of opposing end members, each end member comprising a first aperture;

a plurality of wall members extending between the end members, a first wall member and a second wall member of the plurality of wall members, the plurality of wall members including:

a first pair of wall members of the plurality of wall members cooperate to define a first latitudinal axis thereof that is offset from a longitudinal axis of the float member at a first position; and a second pair of wall members of the plurality of wall members cooperate to define a second latitudinal axis thereof that is offset from the longitudinal axis of the float member at a second position and is parallel to the first latitudinal axis;

wherein the first and second pairs of wall members cooperate to define a subsurface member receiving space; and a subsurface member axle configured to be positioned at least partially within and extend between the first aperture of each of the end members;

a subsurface member configured to be positioned partially within the subsurface member receiving space and extend outward from subsurface member axle, the subsurface member comprising:

an attachment section configured rotatably attach to the subsurface member axle; and a damping member comprising:

a central wall defining a plurality of apertures configured to permit fluid to flow therethrough; and a ballast member positioned at a lower end of the central wall, the ballast member having a greater density than a density of the central wall, the ballast member comprising:

a ballast housing defining an interior volume; and a ballast material positioned within the interior volume of the ballast housing.

* * * * *